United States Patent [19]

Rommel et al.

[11] Patent Number: 4,763,406

[45] Date of Patent: Aug. 16, 1988

[54] WIRING TOOL TO BE EMPLOYED IN THE CUTTER-TERMINAL TECHNIQUE FOR WIRING MULTIPOLE ELECTRIC CONNECTORS, CONTACT STRIPS, AND SIMILAR STRUCTURES INVOLVING

[75] Inventors: Reiner Rommel, Stadtallendorf; Horst Beetz, Wuppertal, both of Fed. Rep. of Germany

[73] Assignee: Wezag GmbH, Stadtallendorf, Fed. Rep. of Germany

[21] Appl. No.: 847,280

[22] Filed: Apr. 2, 1986

[30] Foreign Application Priority Data

Apr. 3, 1985 [DE] Fed. Rep. of Germany ..... 3512157

[51] Int. Cl.[4] ..... H01R 43/042

[52] U.S. Cl. ..... 29/759; 29/566.4; 29/758

[58] Field of Search ..... 29/566.4, 750, 749, 29/748, 758, 751, 752; 7/131, 134; 81/352, 373

[56] References Cited

U.S. PATENT DOCUMENTS 4,125,137 11/1978 Shatto, Jr. ..... 29/749 X 4,527,328 7/1985 Moody et al. ..... 29/749

*Primary Examiner*—Z. R. Bilinsky

*Attorney, Agent, or Firm*—Max Fogiel

[57] ABSTRACT

The invention concerns a wiring tool to be employed in the cutter-terminal technique for wiring multipole electric connectors, contact strips, and similar structures, with a support and a retainer for the connector that accommodates the conductors that are to be connected and with the support capable of being displaced parallel to itself and to the retainer or vice versa, wherein the support and retainer constitute an interchangeable head that adapts to an extremely wide range of applications and that can be mounted on and dismounted from a transmission, characterized in that the transmission consists of a device that is driven by an electric motor.

10 Claims, 3 Drawing Sheets

WIRING TOOL TO BE EMPLOYED IN THE CUTTER-TERMINAL TECHNIQUE FOR WIRING MULTIPOLE ELECTRIC CONNECTORS, CONTACT STRIPS, AND SIMILAR STRUCTURES INVOLVING

The invention concerns a wiring tool to be employed in the cutter-terminal technique for wiring multipole electric connectors, contact strips, and similar structures. Tools of this type are described in DBP No. 3 137 209 and No. 3 338 816. They are provided with a support and with a retainer for the connector that accommodates the conductors that are to be connected, with the support capable of being displaced parallel to itself and to the retainer or vice versa. The support accordingly rests in its mount on at least one wedge that can be linearly displaced by means of a tappet. The mechanism is activated by means of a pistol grip mounted on the device and moving a tappet that forces the conductor into a cutter terminal in the connector. The support and retainer are accommodated in an interchangeable head that constitutes the mounting. Since tools of this type can only be operated manually, their output is relatively limited and the operation as such is difficult.

The object of the invention is to eliminate these drawbacks.

This object is attained in accordance with the invention in that the transmissiosn consists of a device that is driven by an electric motor. The transmission is, along with its associated interchangeable heads, intended for both manual and electric operation. The heads can be mounted on either a manually or on an electrically powered transmission. For electric-motor drive the interchangeable heads are activated with an elbow-lever drive mechanism and there is a crank drive mechanism between these and the motor.

Figure 1:
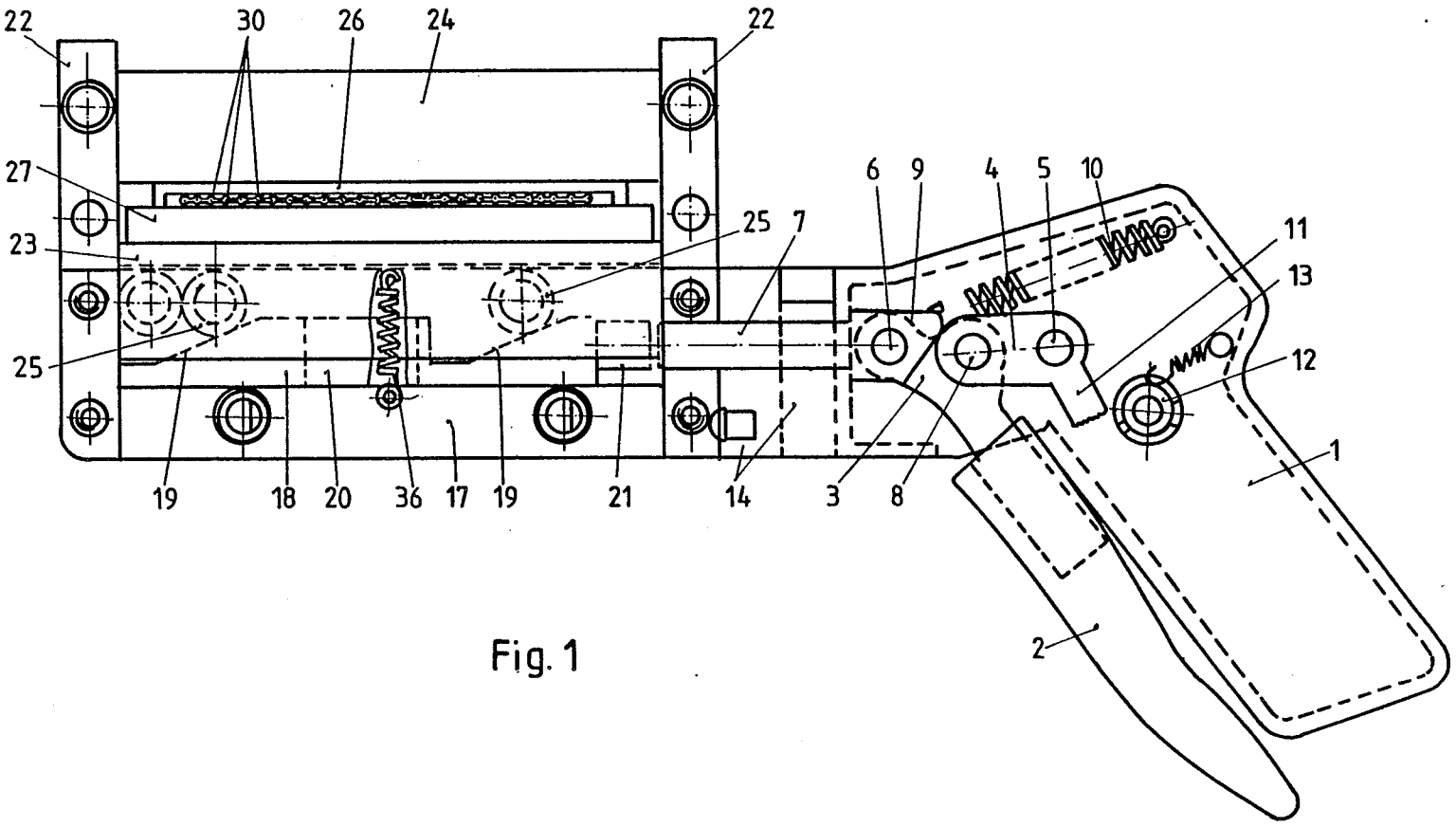
Figure 2:
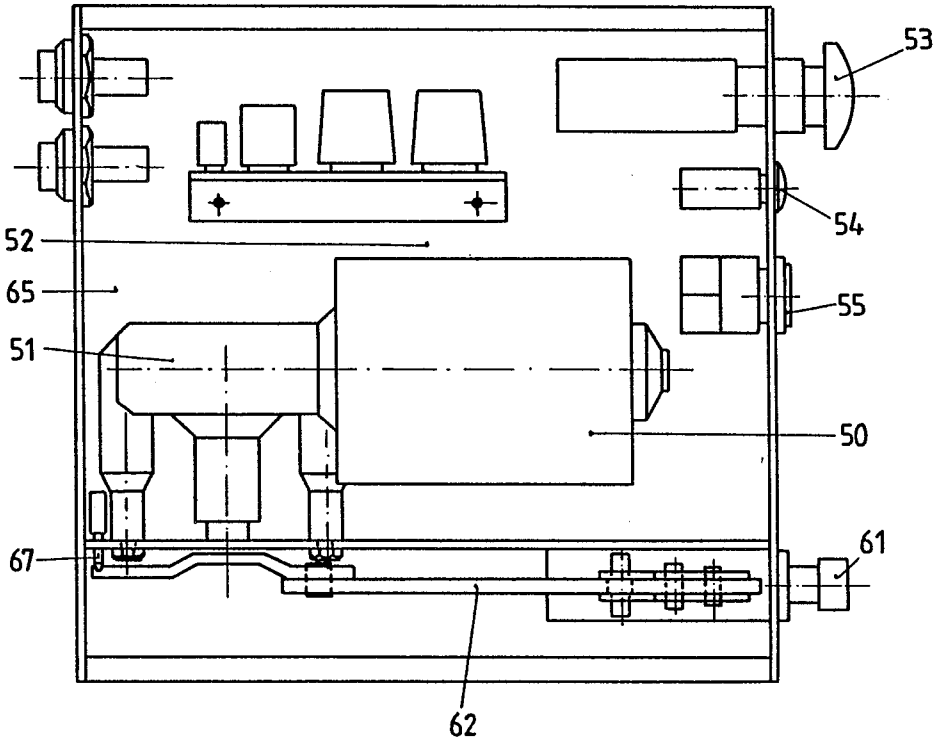
Figure 3:
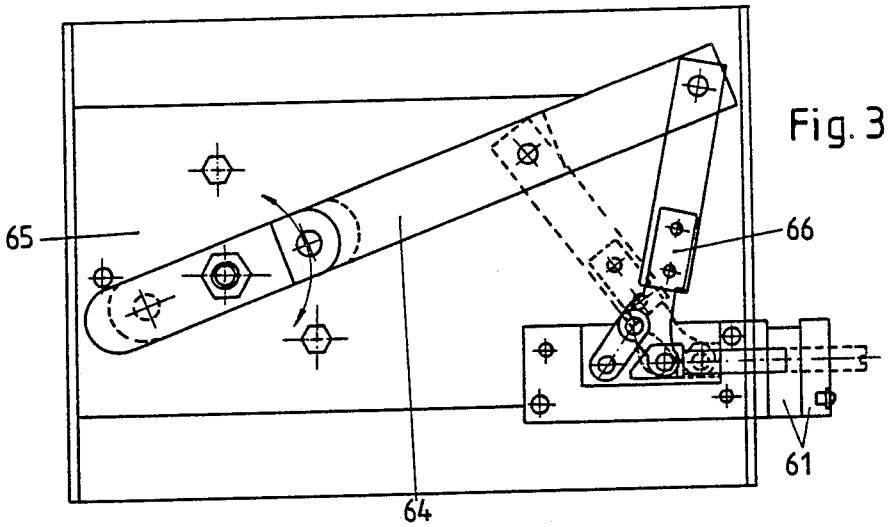
Figure 4:
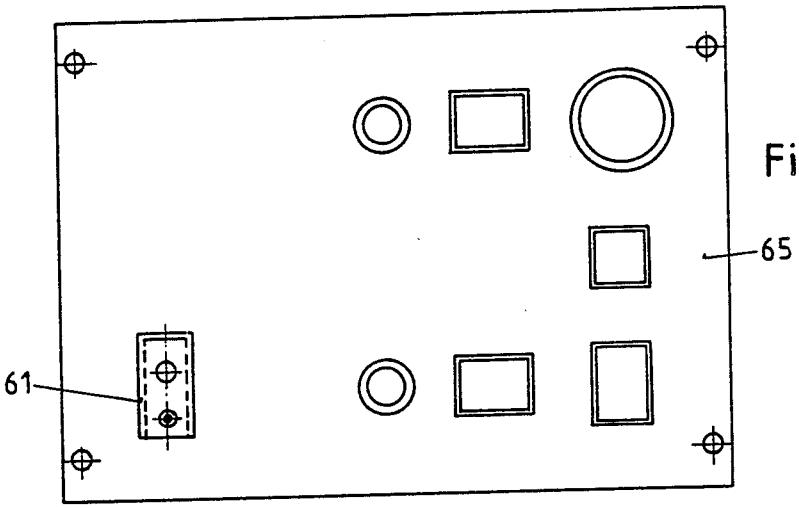
Figure 5:
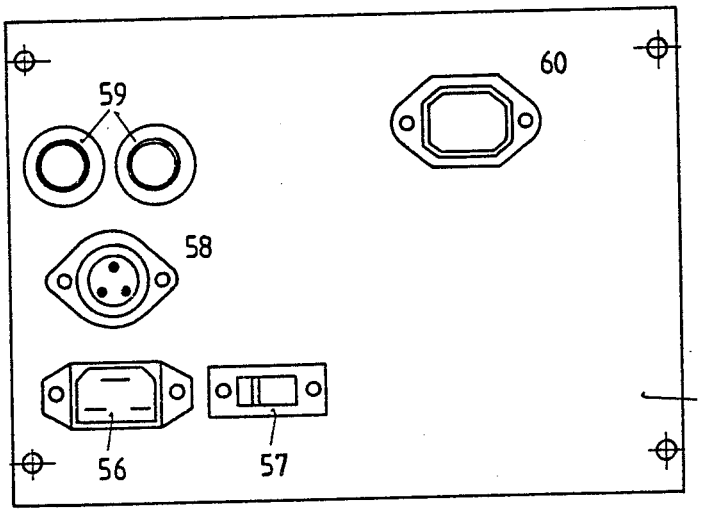

The theory behind the invention is susceptible of very many potential embodiments. One of these is illustrated in the attached drawings, wherein FIG. 1 is a schematic illustration of a device equipped with a pistol grip for activating the tool, represented as out of operation and FIGS. 2 and 5 illustrate how the tool operates when driven by an electric motor, with specifically FIG. 2 being a stop view, FIG. 3 illustrating the drive mechanism, FIG. 4 being a front view, and FIG. 5 being a rear view.

The wiring tool functions identically in principle for both manual and electric operation. FIG. 1 illustrates the drive mechanisms involved in manual operation.

The activating device has a hollow handle 1 equipped with a pistol grip 2. Pistol grip 2 rests against an elbow-lever drive mechansim consisting of levers 3 and 4 and mounted on pivots 5 and 6, which rest in turn on the end of a tappet 7 that slides back and forth longitudinally in housing 1. Pivot 8 connects the two elbow levers 3 and 4. A tension spring 10 that engages the end 9 of tappet 7 forces the tappet back into its rest position when pistol grip 2 is released.

Elbow lever 4 has a toothed section 11 that operates in conjunction with an in itself known stop 12 and 13 to prevent tappet 7 from returning to its rest position until one complete operating stroke has been carried out.

On the front of housing 1 is a neck 14, which tappet 7 slides back and forth in and which the individual interchangeable heads that are to be employed in conjunction with the activating device can be slid onto in accordance with a guide provided thereon in such a way that they can be removed. A resilient snap-in structure prevents the head from being removed unintentionally.

The interchangeable head in accordance with the invention, different types of which can be mounted on the activating device depending on the type of wiring to be carried out, comprises a chamber 18 consisting of two rigid walls 17 and merging into the guide 15. A wedge 20 provided with a series of two sloping surfaces 19 slides back and forth longitudinally inside chamber 18. A mount 21 on one end of the wedge rests against tappet 7, which extends into chamber 18.

At each end of the walls 17 that constitute chamber 18 are similarly constructed tie rods 22 that constituted guides for a support 23 and for a retainer 24. The cross-section of support 23 is in a practical way in the shape of an upside-down U with supporting rollers 25 mounted between its legs. Support 23 rests on rollers 25 on the sloping surfaces 19 of sliding wedge 20. A tie rod 36 secured in chamber 18 maintains support 23 at its bottommost position, with supporting rollers 25 resting against sloping surfaces 19.

A flat-ribbon cable 30 is to be connected by means of a two-component connector 26 and 27 as illustrated in FIG. 1. The two components are clamped together with cable 30 between them between support 23 and retainer 24 when pistol grip 2 is squeezed, causing elbow-lever drive mechanism to advance tappet 7 into chamber 18, where the tappet thrusts sliding wedge 20 forward.

Retainer 24, also called an adapter, which is secured between tie rods 22, can be adjusted to various compression levels in accordance with the type of connector employed. Tie rods 22 are accordingly provided with bores at various heights and accommodating knurled pins that extend through the tie rods and retainer.

The compression level can be varied and adjusted and, in particular, the support and retainer alligned parallel by means of eccentric bolts in the bottom of chamber 18 that support the rollers that sliding wedge 20 rests on.

An interchangeable head 17 and 18 is mounted in a known way on wiring tool 1 and 2. The particular compression level for the connector being employed must be adjusted first. The pressure needed to clamp the components of the connector together with the cable between them is exerted by means of pistol grip 2, displacing sliding wedge 20 to the requisite extent.

The device illustrated in FIGS. 2 to 5 is an electric-motor drive mechanism in a housing 65 that includes a motor 50, an upstream drive mechanism 51, controls 52, conventional activating mechanisms 53, 54, and 55, and the connection and activating elements conventional for supplying outside electric power.

There are a mains connection 56, a 110-220 V voltage selector 57, a pedal 58, and a fuse 59. There is also a battery connection 60. The heads are mounted with an accommodation 61 and by means of an elbow-lever transmission 62.

Inside housing 65 a crank mechanism 64 or elbow-lever drive mechanism 66 like that employed for manual operation as illustrated in FIG. 1 is positioned between drive mechanism 51 and motor 50 and the accommodation 61 for the heads. The tool is turned off automatically with a limit switch 67.

The heads or the head accommodation are designed to ensure that an extremely wide range of heads of different types and sizes can be utilized in both manual and electric operation.

We claim:

1. A wiring tool arrangement using a cutter-terminal technique for wiring multipole electric connectors, contact strips and similar structures carrying conductors to be connected, comprising: a support; a retainer for the connector, said support and said retainer being displaceable parallel relative to one another; said support and retainer comprising an interchangeable head that can be mounted on and dismounted from transmission means operable by a manual hand tool and a motor-driven tool; a handle with a pistol grip; an elbow-lever drive means resting against said pistol grip and comprising levers mounted on pivots resting on an end of a tappet member slidable back and forth longitudinally; a pivot connecting said elbow levers; a tension spring engaging said end of said tappet member and forcing said tappet member into a rest position when said pistol grip is released; stop means, one of said elbow levers having a toothed section operation in conjunction with said stop means to prevent said tappet member from returning to said rest position until one complete operating stroke has been carried out; a housing have a front side with a neck in which said tappet member slides back and forth, individual interchangeable heads being slidable on a guide in said housing and being removable from said guide and said housing; a resilient snap-in means for preventing a head from being removed unintentionally.

2. A wiring tool arrangement as defined in claim 1, wherein said interchangeable head comprises chamber means having two rigid walls and merging into said guide; a wedge member having a series of two sloping surfaces sliding back and forth longitudinally inside said chamber means; a mount on one end of said wedge member and resting against said tappet member, said tappet member extending into said chamber means; tie rods at each end of said walls and forming guides for said support and said retainer; said support having a cross-section with an inverted U-shape, supporting rollers being mounted between legs of said U-shape; said support resting on said rollers on said sloping surfaces of said sliding wedge member; a tie rod in said chamber means maintaining said support at a bottom-most position with said supporting rollers resting against said sloping surfaces.

3. A wiring tool arrangement as defined in claim 1, including a flat-ribbon cable connected by a connector with two components clamped together with said cable between them, said two clamped components with said cable being located between said support and said retainer when said pistol grip is squeezed, so that said elbow-lever drive means advances said tappet member into said chamber means where said tappet member thrusts said sliding wedge member forward.

4. A wiring tool arrangement as defined in claim 2, wherein said retainer is secured between said tie rods and is adjustable to various compression levels dependent on the type of connector used, said tie rods having bores at various heights and accommodating knurled pins extending through said tie rods and said retainer.

5. A wiring tool arrangement as defined in claim 3, including eccentric bolts in bottom of said chamber means for supporting said rollers resting on said sliding wedge member to adjust and vary the compression level.

6. A wiring tool arrangement using a cutter-terminal technique for wiring mutlipole electric connectors, contact strips and similar structures carrying conductors to be connected, comprising: a support; a retainer for the connector, said support and said retainer being displaceable parallel relative to one another; said support and retainer comprising an interchangeable head that can be mounted on and dismounted from transmission means selectively operable by a manual hand tool or a motor-driven tool; an elbow-lever drive means for actuating said interchangeable head; and a crank drive means between said head and said motor-driven tool; said elbow lever drive means having a variable transmission ratio and elbow point said lever drive means having a lever with variable length and an extended position, said lever having a reduced length as the elbow point moves closer to the extended position of the lever to increase the transmission ration for reducing the force required to operate said wiring tool arrangement.

7. A wiring tool arrangement as defined in claim 6, wherein said motor-driven tool comprises an electric tool.

8. A wiring tool arrangement as defined in claim 6, wherein said transmission means can be interchangeably operated by manual means and electrically-powered means.

9. A wiring tool arrangement as defined in claim 6, wherein said motor-driven tool comprises an electric tool; said transmission means being interchangeably operated selectively by manual means or electrically-powered means.

10. A wiring tool arrangement using a cutter-terminal technique for wiring multipole electric connectors, contact strips and similar structures carrying conductors to be connected, comprising: a support; a retainer for the connector, said support and said retainer being displaceable parallel relative to one another; said support and retainer comprising an interchangeable head that can be mounted on and dismounted from transmission means selectively operable by a manual hand tool or a motor-driven tool; a handle with a pistol grip; an elbow-lever drive means resting against said pistol grip and comprising levers mounted on pivots resting on an end of a tappet member slidable back and forth longitudinally; a pivot connecting said elbow levers; means engaging said end of said tappet member and forcing said tappet member into a rest position when said pistol grip is released; stop means, one of said elbow levers having a toothed section operating in conjunction with said stop means to prevent said tappet member from returning to said rest position until one complete operating stroke has been carried out.

* * * * *